United States Patent [19]

Baba

[11] 4,252,032

[45] Feb. 24, 1981

[54] ROTATABLE OPERATING LEVER LOCKING DEVICE

[75] Inventor: Masanao Baba, Takarazuka, Japan

[73] Assignee: Nippon Cable System, Inc., Hyogo, Japan

[21] Appl. No.: 50,629

[22] Filed: Jun. 21, 1979

[30] Foreign Application Priority Data

Oct. 3, 1978 [JP] Japan ..... 53/136653[U]

[51] Int. Cl.[3] ..... G05G 5/22

[52] U.S. Cl. ..... 74/531; 188/67; 188/72.7

[58] Field of Search ..... 74/531, 536, 537, 527; 188/67, 72.7, 72.8, 343

[56] References Cited

U.S. PATENT DOCUMENTS

| | | | |
|---|---|---|---|
| 2,561,546 | 7/1951 | Wallace | 74/536 X |
| 2,655,051 | 10/1953 | Finkl | 74/536 |
| 3,556,270 | 1/1971 | Comment | 74/531 X |
| 3,727,482 | 4/1973 | Geer | 74/531 |
| 3,826,156 | 7/1974 | Dornaus | 74/531 X |

*Primary Examiner*—C. J. Husar
*Assistant Examiner*—Moshe I. Cohen
*Attorney, Agent, or Firm*—Armstrong, Nikaido, Marmelstein & Kubovcik

[57] ABSTRACT

A locking device includes an annular locking face formed on the inner surface of a casing and an annular lockable face opposed to the locking face and provided on a driven member turnably mounted on the casing. The lockable face is movable into pressing contact with the locking face to lock a lever when the lever is rotated and thereby screwed in toward one direction longitudinally thereof. The locking face and the lockable face are operable free of any local uneven wear, while the lever can be locked to the desired position and unlocked therefrom with high reliability at all times.

3 Claims, 3 Drawing Figures

ROTATABLE OPERATING LEVER LOCKING DEVICE

BACKGROUND OF THE INVENTION

The present invention relates to a novel locking device for a rotatable operating lever. More particularly the invention relates to a device for locking a rotatable operating lever which, like the throttle operating lever of a remote control unit for marine engines, must be frequently turned during navigation and also locked to a suitable turned position to propel the boat at a constant speed.

FIGS. 1 and 2 show a conventional device for locking such a rotatable operating lever. The locking device comprises a driven member 40 mounted at its shaft portion 42 on a casing 36 and turnable in the direction of an arrow F or arrow B, a lever 30 attached to the outer side of the casing 36 by the shaft 42 and rotatable by a handle 32 in the direction of an arrow D or arrow E, a locking member 44 having a tapered portion 46 and an internally threaded portion 48 non-rotatably in engagement with an externally threaded outer peripheral portion of the lever 30, a locking plate 50 fixedly attached to the casing 36 and formed with a circular arc V-groove 52 concentric with the shaft 42, retaining means 56 for preventing the lever 30 from slipping off the driven member 40, and an end shaft 54 of a control cable having one end pivoted to the driven member 40 and the other end connected, for example, to an unillustrated throttle member. When rotated in one direction, the lever 30 brings the tapered portion 46 into pressing contact with the V-grooved portion 52, whereby the lever 30 can be locked to the desired position. Since the throttle lever 30 adapted for use with marine engines is usually locked to an approximately definite turned position (for example, to the position indicated in two-dot-and-dash lines in FIG. 1), so as to propel the boat economically at a constant speed, the V-grooved portion 52 wears away rapidly at this position. When the lever 30 is slightly rotated in the other direction to unlock the tapered portion 46 from such a locally worn portion of the locking plate 50 and the tapered portion 46 is slightly moved away from the V-groove 52 of the plate 50, the tapered portion 46 will sometimes come into pressing contact with an unworn part of the V-grooved portion 52 upon turning the lever, thus preventing the turn of the lever 30 at an undesired position. The lever 30 can then be turned to another unworn position only after the lever 30 has been further rotated in the other direction. If the lever 30 is thus inadvertently lockable at an undesired position, the lever 30 is not operable as quickly as is desired. A dangerous situation, such as a collision, could then result.

The conventional device has another drawback. When the tapered portion 46 is held pressed against a slanting portion on either side of the worn grooved portion, the vibration of the boat is liable to shift the tapered portion 46 to the lowest position of the worn grooved portion. Thus the lever will shift abruptly.

OBJECTS OF THE INVENTION

The main object of the present invention is to provide a device for locking a rotatable operating lever which device is operable free of any local uneven wear even when the lever is frequently locked at a definite position.

Another object of the invention is to provide a locking device by which a rotatable operating lever can be locked to the desired position and unlocked therefrom with high reliability.

Another object of the invention is to provide a device for locking a rotatable operating lever which device is rendered free from seawater and dust, made operable without wear or the corrosion to be otherwise caused by salt and thereby adapted to lock the lever free of any trouble for a prolonged period of time.

These and other objects of the invention will become more apparent from the following description with reference to the accompanying drawings.

DETAILED DESCRIPTION OF THE INVENTION

Figure 1:
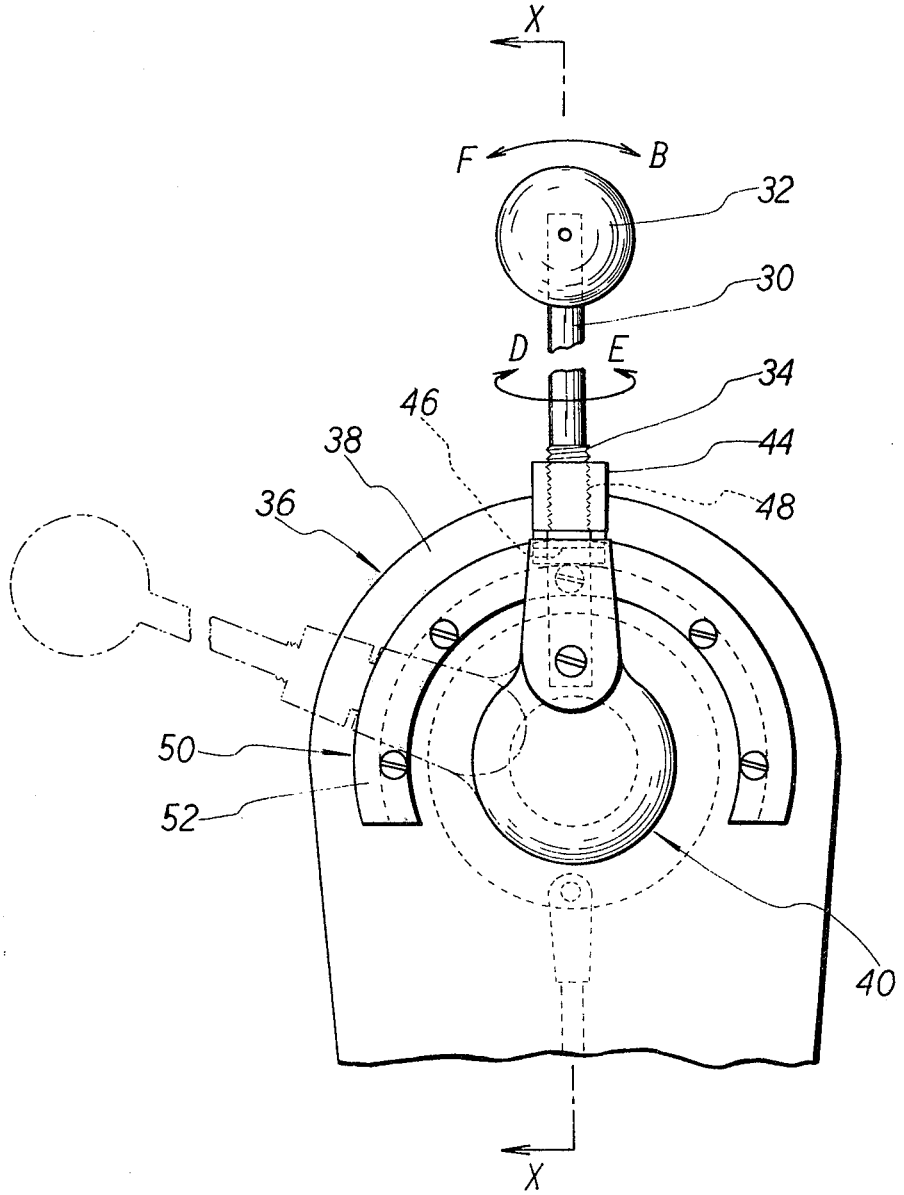
FIG. 1 PRIOR ART
FIG. 1 is a front view partly broken away and showing a conventional device for locking a rotatable operating lever.
Figure 2:
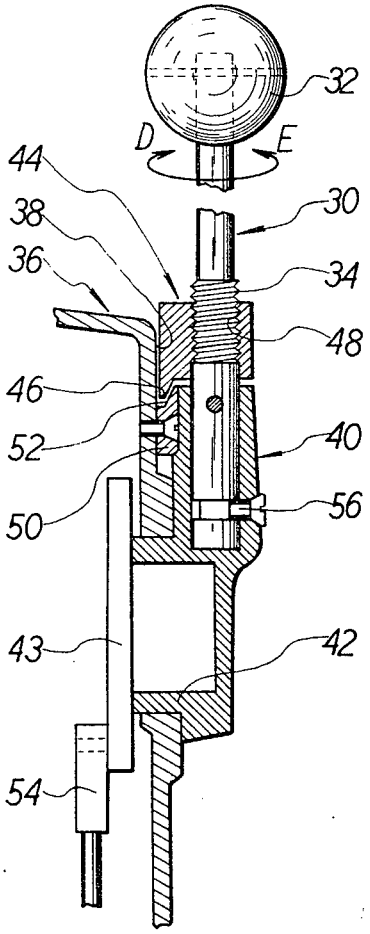
FIG. 2 PRIOR ART
FIG. 2 is a view in section taken along the line X—X in FIG. 1.
Figure 3:
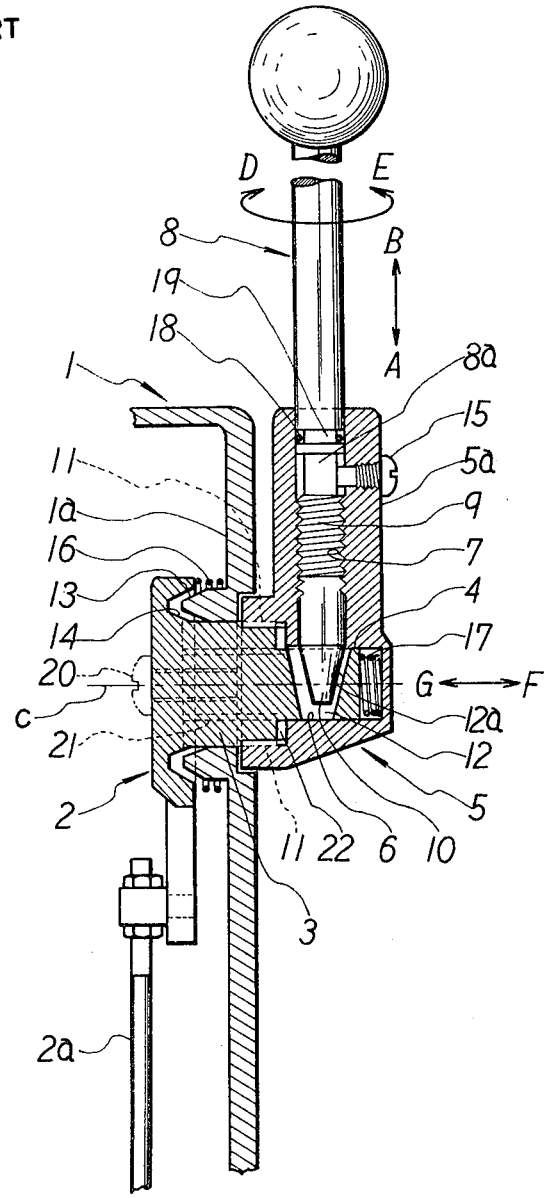
FIG. 3 is a front view partly broken away and showing an embodiment of the device of the present invention for locking a rotatable operating lever.

With reference to FIG. 3, a driven member 2 is turnably attached to a casing 1 by a shaft 3. A projecting shaft portion 4 coaxial with the shaft 3 projects outward from the casing 1. A lever base portion 5 is formed with a cavity 6 into which the projecting shaft portion 4 is smoothly insertable longitudinally thereof. The base portion 5 is provided with a tubular portion **5*a* substantially at right angles with the axis c of the shaft 3. The tubular portion 5*a* has an internally threaded portion 7. A rotatable operating lever 8 is circular in cross section and has an externally threaded portion 9 positioned at a suitable location and engageable with the internally threaded portion 7. The lever 8 has a conical base end 10**.

The outer periphery of the shaft 3 and the inner periphery of the base portion 5 are formed, for example, with serrations 11, whereby the shaft 3 and the base portion 5 are held in engagement with each other and made slidable relative to each other along the axis c.

The projecting shaft portion 4 has a bore 12 defined by a tapered surface **12*a*, such that the conical end 10, when vertically moved in the direction of an arrow A, pushes the projecting shaft portion 4** toward the direction of the projection, namely in a direction F.

The casing 1 is formed on its inner surface **1*a* with a projection tapered in section as seen in FIG. 3 and providing an annular locking face 13 centered about the axis c. The driven member 2 has a recess tapered in section as shown in FIG. 3 and providing an annular lockable face 14 opposed to the locking face 13 and centered about the axis c. The projecting locking face 13 and the recessed lockable face 14** need not always be tapered.

A control cable has one end pivoted to the driven member 2 by an end shaft (hereinafter referred to as "control cable") **2*a*** and the other end connected, for example, to throttle means (not shown).

The lever 8 has a small-diameter portion **8*a* positioned within the tubular portion 5*a*. A retaining screw 15 is screwed in the tubular portion 5*a* with its forward end positioned close to the outer periphery of the small-diameter portion 8a to prevent the lever 8 from slipping off from the tubular portion 5a** in a direction B.

Indicated at 16 is an elastic member interposed between the inner surface 1a of the casing 1 and the driven member 2 in a somewhat compressed state, and at 17 another elastic member somewhat compressed and accommodated in the cavity 6 between the base portion 5 and the projecting shaft portion 4. The elastic members 16 and 17 bias the locking face 13 and the lockable face 14 away from each other. Depending on the shape of the locking face 13 which is complementary to that of the lockable face 14, the elastic member 16 and/or the elastic member 17, or neither of the members 16 and 17 may be necessary, while such members, when used, act effectively for unlocking as will be described later.

The operation and advantages of the present device will now be described. The lever 8, when turned forward or backward, turns the base portion 5 similarly, thereby moving the control cable 2a to control the throttle means.

To lock the lever 8 to the desired forwardly or backwardly turned position, the lever 8 is rotated in the direction D and screwed in, whereby the lever is moved in the direction A by virtue of engagement between the internally threaded portion 7 and the externally threaded portion 9. Consequently the conical end 10 pushes the tapered surface 12a in the direction F, moving the shaft 3 in the same direction F to bring the lockable face 14 of the driven member 2 into pressing contact with the locking face 13. Since the shaft 3 slides along the serrations 11 toward the base portion 5 in the direction F at this time, the shaft 3 comes into contact with the base portion 5 and the lever 8 which remain against movement, whereby the lever 8 is completely locked to the desired position against forward or backward turning. When the lever 8 in the locked state is rotated in the direction E and loosened, the lever 8 retracts in a direction B, bringing the lockable face 14 out of pressing contact with the locking face 13. The driven member 2 is now freely turnable forward or backward by the lever 8.

When the locking face 13 is provided by a tapered projection and the lockable face 14 by a tapered recess as shown in FIG. 3, it may sometimes be difficult to free the lockable face 14 from pressing contact with the locking face 13 even by rotating the lever 8 in the direction E for loosening. In such a case, the elastic member 16 and/or the elastic member 17, if used, will act very effectively for releasing the lockable face 14 from the locking face 13 with ease.

Since the locking face 13 and the lockable face 14 are both annular, these faces will not be worn away locally by being locally pressed against each other. Unlike the conventional device, therefore, the present device locks and unlocks the lever 8 properly at all times.

Furthermore, both the locking face 13 and the lockable face 14, which are housed in the casing 1, are made free from seawater or dust, are not subject to abrasion or corrosion due to the presence of salt and are therefore operable for a prolonged period of time to lock the lever 8 free of any trouble.

To prevent ingress as of seawater through the clearance between the tubular portion 5a and the lever 8, the lever 8 may be formed with an annular groove 19 for placing a packing 18 in by press fit, thereby eliminating the space in the tubular portion 5a around the lever 8. Further to render the throttle cable 2a pivoted to the driven member 2 shiftable relative to the direction of turn of the lever 8 as desired, the projecting shaft portion 4 and the shaft 3 may be provided as separate members, with a bore 21 formed in the shaft 3 for the projecting shaft portion 4 to engage in, such that the shaft portion 4 is inserted into the shaft 3 and fastened thereto with a bolt 20. Although unillustrated, an elastic member may be placed in a clearance 22 between the tubular portion 5 and the shaft 3.

What is claimed is:

1. A rotatable operating lever locking device comprising a driven member turnably attached to a casing by a shaft integral with the driven member, a lever base portion in engagement with the shaft and movable axially of the shaft, a tubular portion extending from the base portion substantially at right angles with the axis of the shaft and having an internally threaded portion, a lever partly extending into the tubular portion and having an externally threaded portion in engagement with the internally threaded portion and a conical base end, a recessed portion formed in the base portion for accommodating a shaft portion projecting from the shaft outwardly of the casing, a bored portion formed in the projecting shaft portion and having a tapered surface for causing the conical end to move the shaft portion toward the direction of the projection when the conical end is vertically moved in one direction, an annular locking face formed on the inner surface of the casing and concentrical with the shaft, and an annular lockable face formed on the driven member and opposed to the locking face concentrically with the shaft, the lockable face being movable into pressing contact with the locking face by the lever to lock the lever when the lever is rotated and thereby screwed in said one direction longitudinally thereof.

2. The device of claim 1, wherein an elastic member is provided in a space between the driven member and the inner surface of the casing for biasing the locking face and the lockable face away from each other.

3. The device of claim 1, wherein an elastic member is provided in a space between the lever base portion and the shaft or the projecting shaft portion for biasing the locking face and the lockable face away from each other.

* * * * *